US009837053B1

(12) United States Patent
Cheng et al.

(10) Patent No.: US 9,837,053 B1
(45) Date of Patent: Dec. 5, 2017

(54) DISPLAY METHOD OF DISPLAY DEVICE

(71) Applicant: NOVATEK MICROELECTRONICS CORP., HsinChu (TW)

(72) Inventors: Jhih-Siou Cheng, New Taipei (TW); Po-Hsiang Fang, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

(21) Appl. No.: 15/176,131

(22) Filed: Jun. 7, 2016

(51) Int. Cl.
*G09G 5/393* (2006.01)

(52) U.S. Cl.
CPC ..... *G09G 5/393* (2013.01); *G09G 2320/029* (2013.01); *G09G 2320/103* (2013.01); *G09G 2360/08* (2013.01); *G09G 2360/12* (2013.01)

(58) Field of Classification Search
None
See application file for complete search history.

(56) References Cited

U.S. PATENT DOCUMENTS

| | | | | |
|---|---|---|---|---|
| 9,247,243 | B1 * | 1/2016 | Namboodiri | H04N 19/117 |
| 2002/0024054 | A1 * | 2/2002 | Koyama | G09G 3/3266 257/84 |
| 2009/0322969 | A1 * | 12/2009 | Unger | G09G 5/003 348/790 |
| 2013/0304604 | A1 * | 11/2013 | Hoffman | G06Q 30/0621 705/26.5 |
| 2015/0350666 | A1 * | 12/2015 | Kovacevic | H04N 19/503 382/173 |

* cited by examiner

*Primary Examiner* — Mark Zimmerman
*Assistant Examiner* — Yu-Jang Tswei
(74) *Attorney, Agent, or Firm* — Rabin & Berdo, P.C.

(57) ABSTRACT

A display method includes steps of: receiving, by the controller, a first frame and a second frame from an input data; up-converting, by the controller, a frame rate of the input data to produce a third frame based on the first frame and the second frame; identifying, by the controller, a static image content of the third frame according to a comparison of the first frame and the second frame; controlling, by the controller, the driver circuit not to update data of pixels within a static display area of the display panel corresponding to the static image content during the period of time that the third frame is displayed by the display panel.

4 Claims, 7 Drawing Sheets

DISPLAY METHOD OF DISPLAY DEVICE

TECHNICAL FIELD

The disclosure relates to a display method of a display device.

BACKGROUND

Recently, high-resolution, high-frame-rate display devices such as 4K2K (4096*2160 pixels) liquid-crystal displays (LCDs) are developed. Under the circumstances, it is intended to use high-speed driver circuits to drive the display panel.

However, as the operation speed of a driver circuit increased, the power consumption of the driver circuit will be higher, causing the operating temperature to rise and adversely affecting the performance of the display device.

Therefore, there is a need to provide a display method capable of reducing the power consumption of driver circuits of a display device.

SUMMARY

The disclosure is directed to a display method of a display device, which can reduce the power consumption of driver circuits without adversely affecting the display quality.

According to an embodiment of the present invention, a display method of a display device including a controller, a display panel and a driver circuit responsive to the controller to drive the display panel is provided. The display method includes steps of: receiving, by the controller, a first frame and a second frame from an input data; up-converting, by the controller, a frame rate of the input data to produce a third frame based on the first frame and the second frame; identifying, by the controller, a static image content of the third frame according to a comparison of the first frame and the second frame; controlling, by the controller, the driver circuit not to update data of pixels within a static display area of the display panel corresponding to the static image content during the period of time that the third frame is displayed by the display panel.

Figure 1:
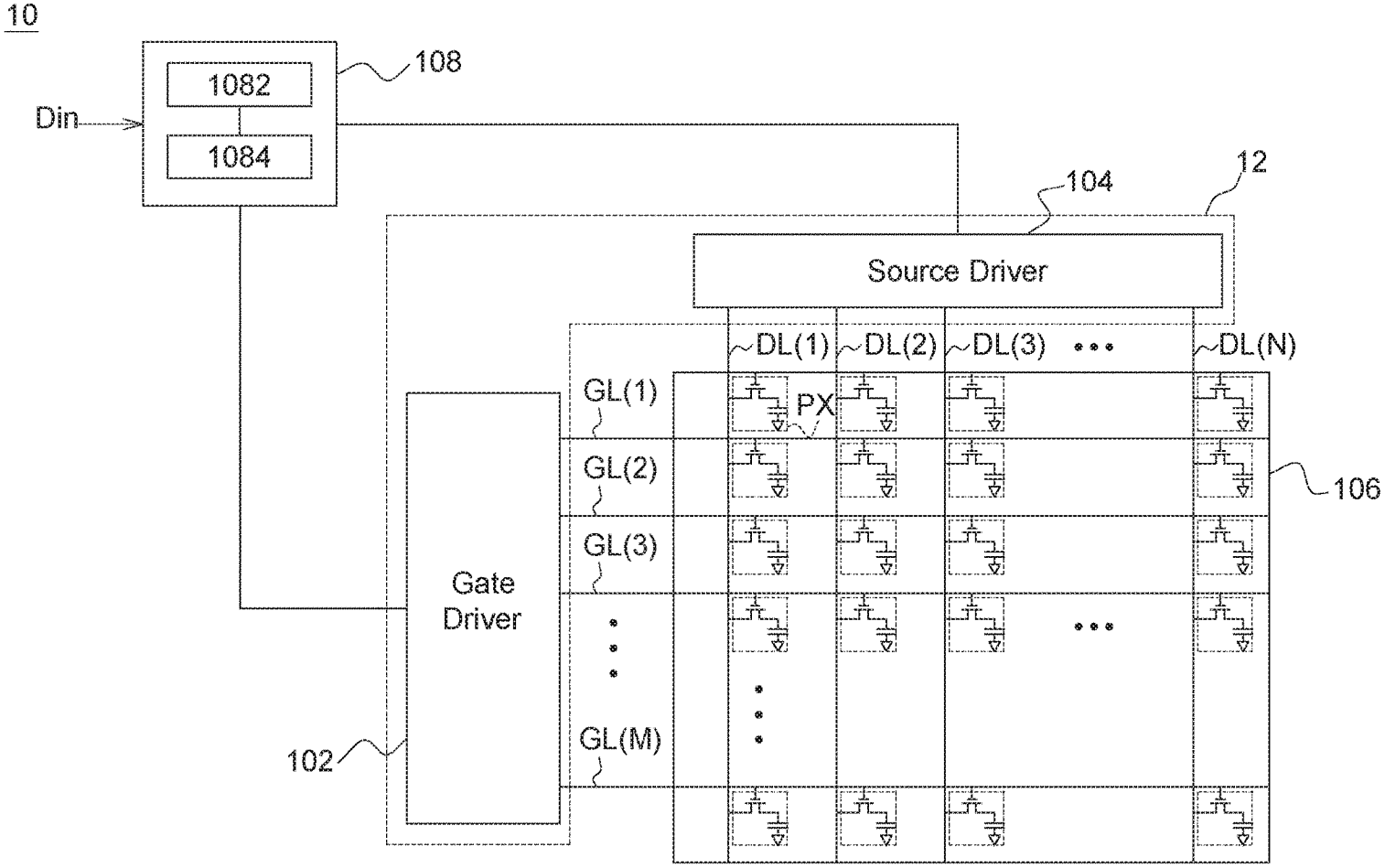
FIG. 1 illustrates a schematic diagram of a display device according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 illustrates a schematic diagram of a display device 10 according to an embodiment of the present invention. The display device 10 includes a controller 108, a display panel 106 and a driver circuit 12 responsive to the controller 108 to drive the display panel 106. The driver circuit 12, for example, includes a gate driver 102 and a source driver 104.

The gate driver 102 and the source driver 104 couple to a plurality of gate lines GL(1)-GL(M) and data lines DL(1)-DL(N), respectively, where M and N are integers. The display panel 106 includes a plurality of pixels PX defined by intersections of the gate lines GL(1)-GL(M) and the data lines DL(1)-DL(N). As shown in FIG. 1, pixels PX in the display panel 106 form an active matrix.

The controller 108 includes a frame rate controller 1082 and a timing controller 1084. The frame rate controller 1082 may receive input data Din from an external video source (not shown) at a first frame rate. The frame rate controller 1082 may process the input data Din by using data compensation technique such as motion estimation motion compensation (MEMO), and output the processed data with a second frame rate to the timing controller 1084. For high display quality, the second frame rate is usually greater than the first frame rate. For example, in a 4K2K display system, the frame rate (first frame rate) of the input data Din is 30 Hz, and the frame rate (second frame rate) of the processed data is 60 Hz or 120 Hz.

Response to the processed data from the frame rate controller 1082, the timing controller 1084 may utilize synchronization signals and/or other timing signals to control the gate driver 102 and the source driver 104 to drive the gate lines GL(1)-GL(M) and the data lines DL(1)-DL(N) with specific driving schemes. When a gate line (e.g., GL(1)) is driven by the gate driver 102, the gate line is enabled, and pixels PX coupled to the enabled gate line can be charged by the corresponding data lines (e.g., DL(1)-DL(N)).

Figure 2:
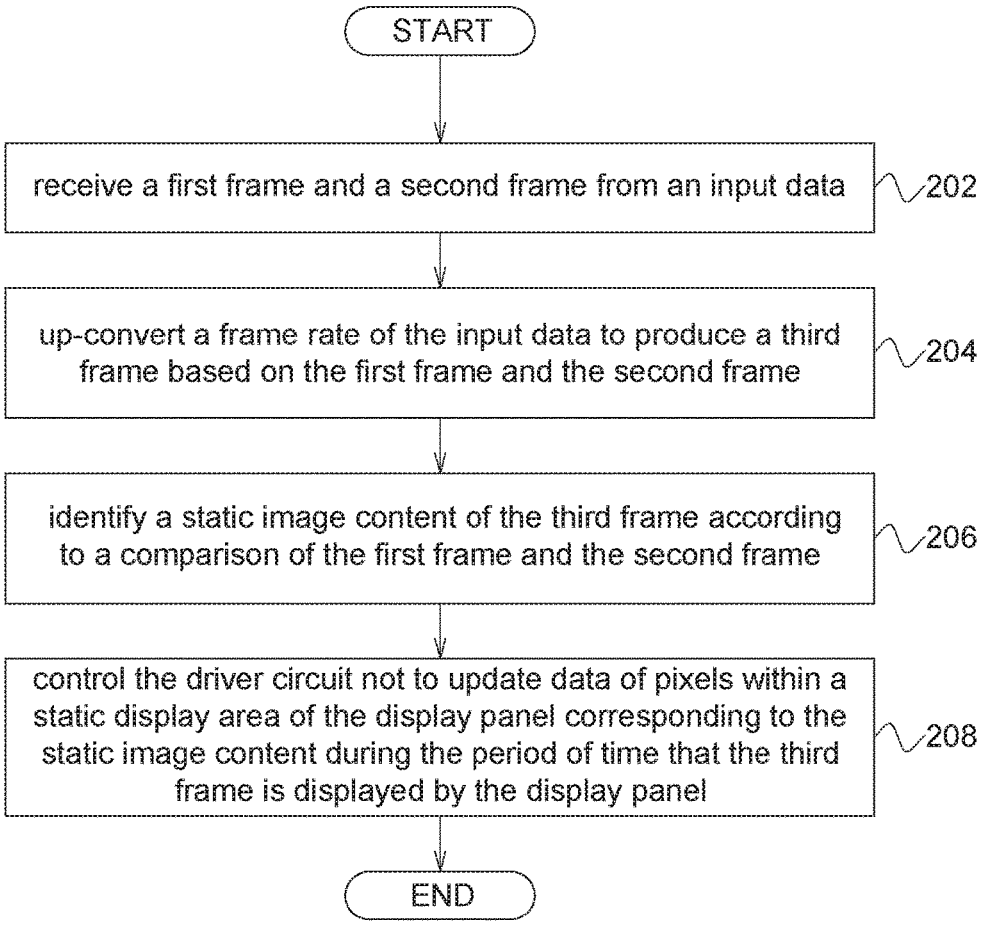
FIG. 2 illustrates a schematic flowchart of a display method of the display device according to an embodiment of the present invention.

FIG. 2 illustrates a schematic flowchart of a display method of the display device 10 according to an embodiment of the present invention. In step 202, the controller 108 receives a first frame and a second frame from the input data Din. The first frame and the second frame may be two successive frames in the input data Din.

In step 204, the controller 108 up-converts the frame rate of the input data Din to produce a third frame based on the first frame and the second frame. The third frame can be deemed as an interleaved frame between the first and second frames in a time sequence, for constituting the processed data with higher frame rate. Taking a 60 Hz 4K2K LCD for example, the controller 108 may process an input data Din with 30 Hz of frame rate to output processed data with doubled frame rate. In such situation, odd frames (including the first and second frames) in the processed data are directly from the input data Din, and even frames (including the third frame) in the processed data are interleaved frames produced by data compensation technique such as MEMC.

The up-conversion of the frame rate of the input data Din can be implemented in various ways. For example, the controller 108 may interpolate the first frame and the second frame to produce the third frame. In another example, the controller 108 may repeat the first frame or the second frame, and take one of the duplicates as the third frame.

In step 206, the controller 108 identifies static image content of the third frame according to a comparison of the first frame and the second frame. For example, the controller 108 may compare the first frame with the second frame, and recognize image content (e.g., background) that remains unchanged (or slightly changed) between the first and second frames as the static image content. Conversely, for image content (e.g., foreground) that varies in different frames, the controller 108 may identify it as dynamic image content.

In step 208, the controller 108 controls the driver circuit 12 not to update data of pixels within a static display area of the display panel 106 corresponding to the static image content during the period of time that the third frame is displayed by the display panel 106. The static display area described herein is an area of the display panel 106 for displaying the static image content of a frame. In an embodiment, the controller 108 may deactivate at least one of the gate driver 102 and the source driver 104 to hold data of pixels within the static display area during the period of time that the third frame is displayed. The deactivation of a gate driver, for example, includes operation of stopping enabling gate lines. The deactivation of a source driver, for example, includes operation of entering in a high-impedance mode or outputting signals to maintain data voltages on the data lines.

In another embodiment, the controller 108 may jump to updating data of pixels within a dynamic display area of the display panel 106 corresponding to the dynamic image content of the third frame by skipping updating data of pixels within the static display area of the display panel 106 in a frame time (which is defined by the second frame rate in step 204 of FIG. 2 for example). The dynamic display area described herein is an area of the display panel 106 for displaying the dynamic image content of a frame. Details about the abovementioned driving schemes will be further elaborated in connection with FIGS. 4-10.

Although data of pixels in the static display area of the display panel 106 may not be updated by the driver circuit 12 during the period of time that an interleaved frame (e.g., the third frame) is displayed, the static image content of the interleaved frame can still be correctly displayed on the display panel 106 because the pixels in the static display area may hold data voltages charged in the previous frame time (e.g., the frame time for the first frame). In this manner, the driver circuit 12 can drive the static display area of the display panel 106 with less update (refresh) frequency, and thus can be provided with reduced power consumption and lowered operating temperature.

Figure 3:
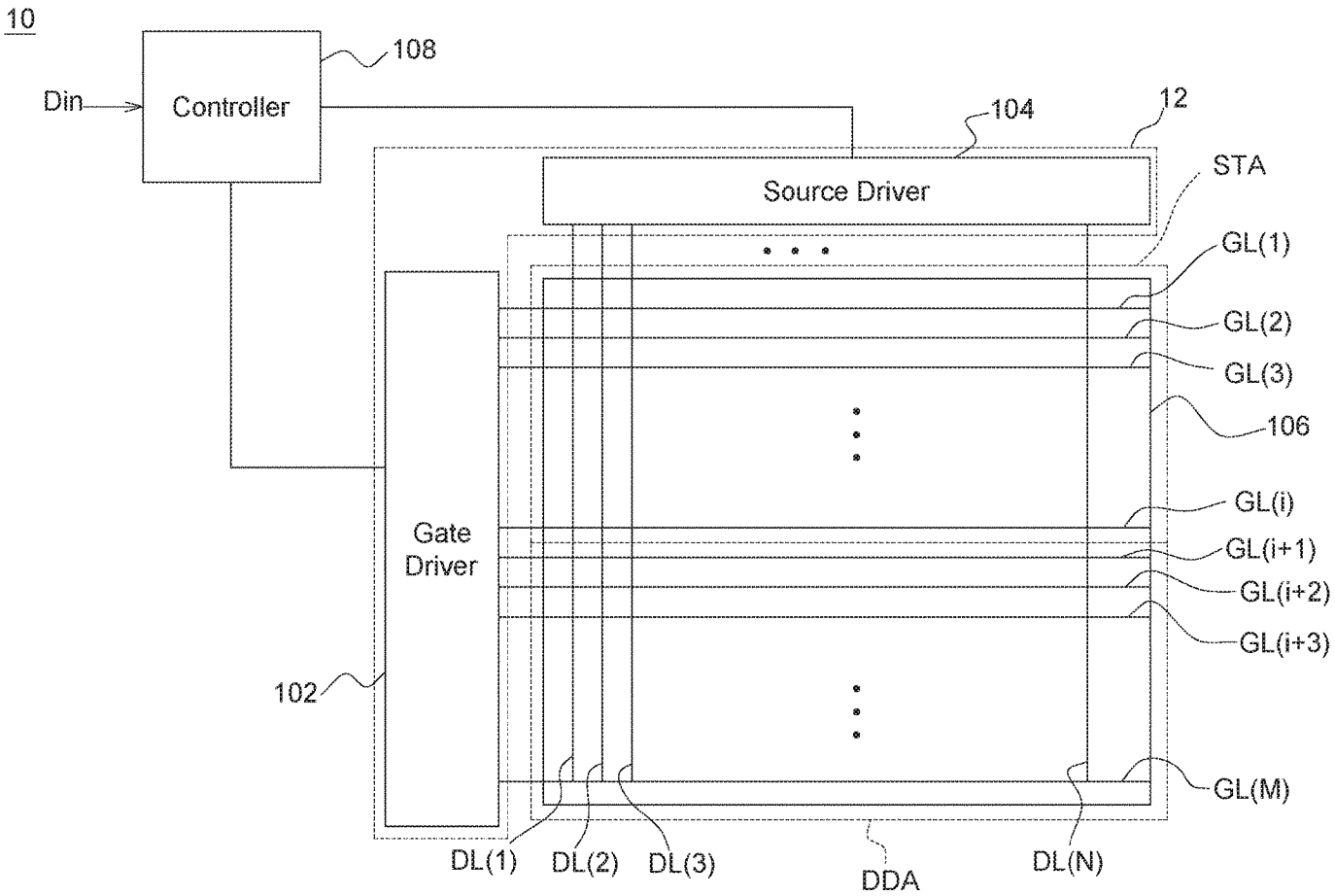
FIG. 3 illustrates a schematic diagram of a static display area and a dynamic display area on the display panel.

FIG. 3 illustrates a schematic diagram of a static display area STA and a dynamic display area DDA on the display panel. In this example, the displayed frame includes static image content in its upper portion and dynamic image content in its lower portion, which are displayed on the static display area STA and the dynamic display area DDA of the display panel 106, respectively. As shown in FIG. 3, the static display area STA includes gate lines GL(1)-GL(i) disposed in the upper portion of the display panel 106, and the dynamic display area DDA includes gate lines GL(i+1)-GL(M) disposed in the lower portion of the display panel 106, where i is an integer and 1<i<M.

Figure 4:
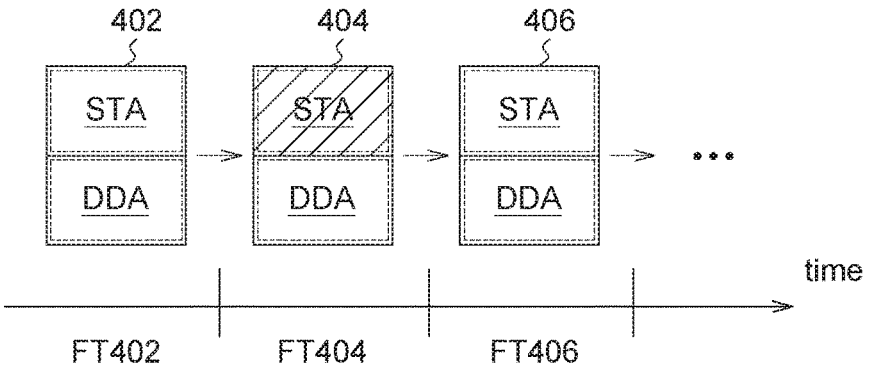
FIG. 4 illustrates a schematic driving scheme for the display panel.

FIG. 4 illustrates a schematic driving scheme for the display panel 106. In this example, the up-converted input data to be displayed includes a sequence of frames 402, 404 and 406 that each has static image content in the upper portion and has dynamic image content in the lower portion. Frames 402, 404 and 406 are sequentially displayed on the display panel 106, wherein frames 402 and 406 are from the input data Din, and frame 404 is an interleaved frame produced based on frames 402 and 406.

In frame time FT402, the display panel 106 is driven by normal scheme. For example, the gate driver 102 may sequentially generate scan signals to enable each gate line GL(1)-GL(M), and meanwhile, the source driver 104 may correspondingly output data signals to the pixels PX coupled to each gate line GL(1)-GL(M), so that the previous displayed content on the display panel 106 can be updated to frame 402. Understandably, the present invention is not limited thereto, and the normal scheme described herein can be implemented by any other known frame-refreshing approaches.

In frame time FT404, the display panel 106 is driven by the proposed power saving scheme to display frame 404. The controller 108 controls the driver circuit 12 not to update the displayed content of the static display area STA by deactivating the gate driver 102 and the source driver 104 (the update-disabled area is represented as a shadowed region in the figure), and further controls the driver circuit 12 updates date of pixels within the dynamic display area DDA only.

In frame time FT406, the display panel 106 is driven by the abovementioned normal scheme to update the displayed content to frame 406. With the illustrated driving scheme, the equivalent frame rate for the static image content in different frames can be reduced by one-half, so the driver circuit 12 can be provided with reduced power consumption.

Figure 5:
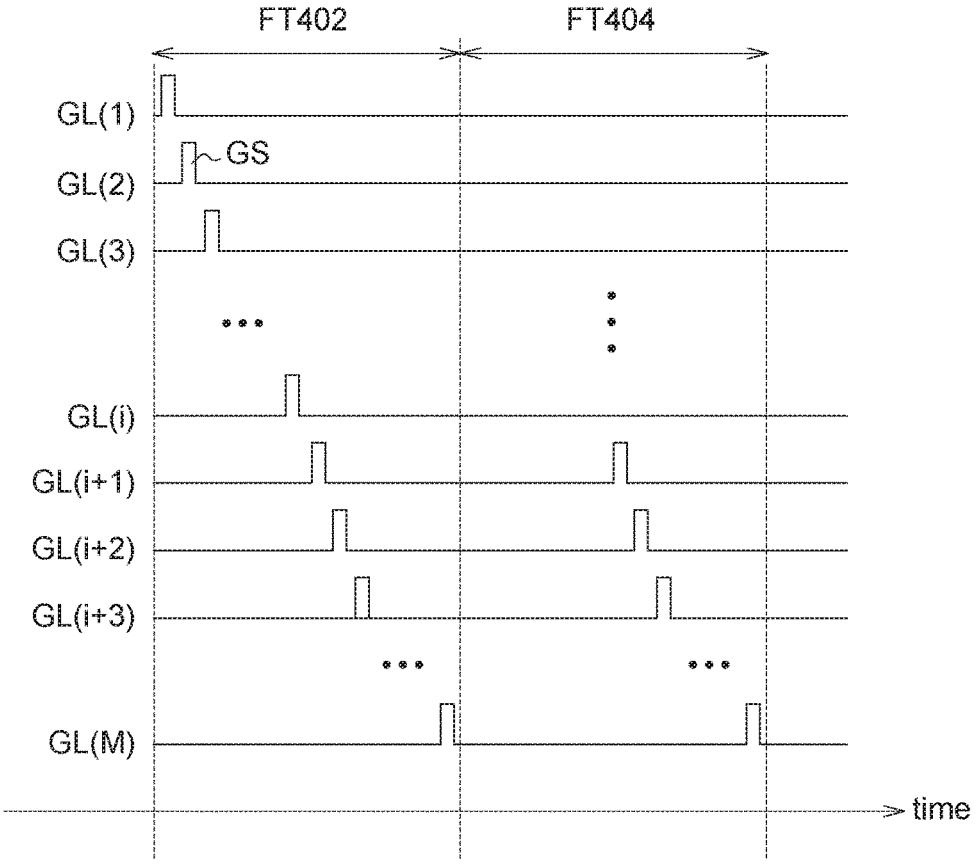
FIG. 5 illustrates a schematic timing chart of operations of the display panel.

FIG. 5 illustrates a schematic timing chart of operations of the display panel 106 during the frame time FT402 and FT404 shown in FIG. 4.

In frame time FT402, the gate driver 102 sequentially enables rows of pixels PX by applying scan signals GS to the gate lines GL(1)-GL(M), such that each pixel on the display panel 106 can be charged to new pixel data for frame 402. By this way, the previous displayed content on the display panel 106 is updated to frame 402.

Then, during a first half of frame time FT404, both the gate driver 102 and source driver 104 are deactivated by the controller 108, such that data of pixels in the static display area STA are maintained but not updated by new frame data for frame 404.

During a second half of frame time FT404, the gate driver 102 and the source driver 104 are reactivated. The gate driver 102 sequentially outputs scan signals GS to each gate line disposed in the dynamic display area DDA, and meanwhile, the source driver 104 correspondingly outputs new pixel data for frame 404 to the data lines, such that the displayed content of the dynamic display area DDA are updated to the dynamic image content of frame 404.

Figure 6:
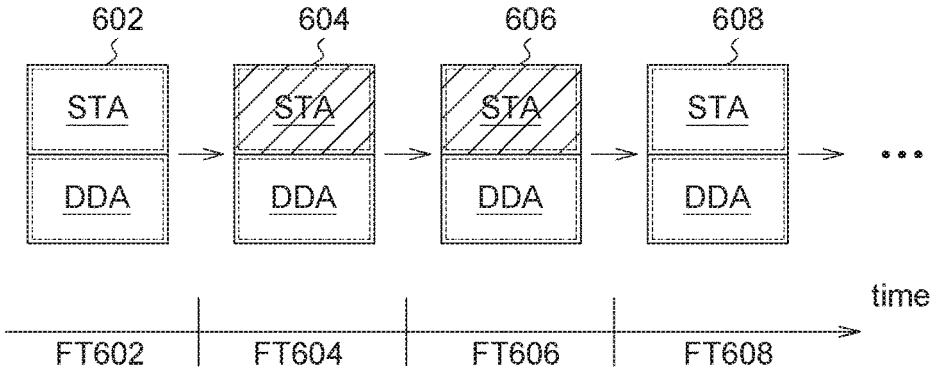
FIG. 6 illustrates another schematic driving scheme for the display panel.

FIG. 6 illustrates another schematic driving scheme of the display panel 106. In the example of FIG. 6, frames 602 and 608 are successive frames from the input data Din, and frames 604 and 606 are interleaved frames produced based on frames 602 and 608 by MEMC technique for example.

The static/dynamic image content of the interleaved frames 604 and 606 can be identified by comparing image contents of frames 602 and 608. For example, given that both frames 602 and 608 include static image content in their upper portion and include dynamic image content in their lower portion, the interleaved frames 604 and 606, which are produced based on the frames 602 and 608, can also be identified as including static image content in their upper portion and including dynamic image content in their lower portion.

In frame time FT602, the display panel 106 is driven by normal scheme. The driver circuit 12 is activated to update the whole displayed content to frame 602.

Then, in frame time FT604 and FT606, the display panel 106 is driven by the proposed power saving scheme. The controller 108 deactivates the driver circuit 12 to disable the update of the displayed content of the static display area STA, and reactivate the driver circuit 12 to update the displayed content of the dynamic display area DDA to the dynamic image content of frame 604/606.

Next, in frame time FT608, the display panel 106 is driven by normal scheme again. The controller 108 activates the driver circuit 12 to update the whole displayed content on the display panel 106 to frame 608.

Although the number of interleaved frames between frames 602 and 608 is exemplified by two in FIG. 6, the present invention is not limited thereto. The number of interleaved frames can be arbitrary, depending on different display applications.

Further, in some embodiments, the display panel 106 can be driven with normal scheme to display one or more interleaved frames containing static image content, to avoid data voltages hold by pixels in the static display area from decaying to a level which may adversely affect the display quality.

Figure 7:
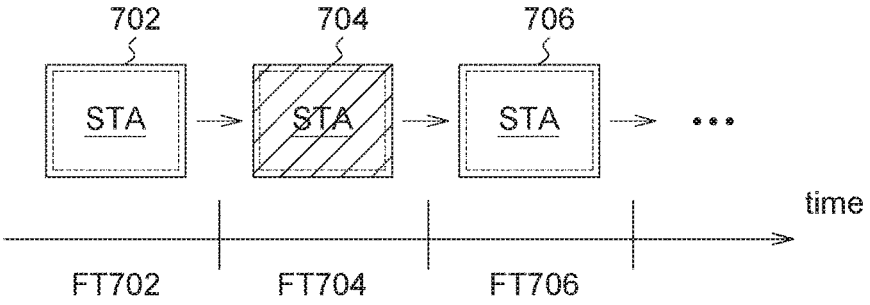
FIG. 7 illustrates another schematic driving scheme for the display panel.

FIG. 7 illustrates another schematic driving scheme of the display panel 106. In the example of FIG. 7, frames 702 and 706 are successive frames from the input data Din, and frame 704 is an interleaved frame produced based on frames 702 and 706.

In this example, frames 702 and 706 are static images (i.e., only static image content is included), so the interleaved frame 704 is a static image, too.

In frame time FT702, the display panel 106 is driven by normal scheme. The controller 108 controls the driver circuit 12 to update the whole displayed content to frame 702.

Then, in frame time FT704, the display panel 106 is driven by the proposed power saving scheme. To reduce power consumption, the controller 108 deactivates the driver circuit 12 to disable the update of pixel data for the static display area STA (the update-disabled area is represented as a shadowed region in the figure), such that pixels on the display panel 106 hold data voltages charged in the previous frame time, i.e., frame time FT702.

Next, in frame time FT706, the display panel 106 is driven by normal scheme. The controller 108 activates the driver circuit 12 to update the whole displayed content on the display panel 106 to frame 706.

Figure 8:
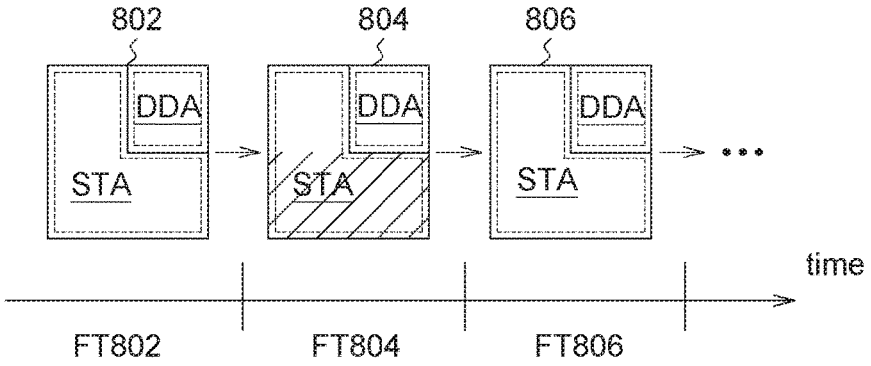
FIG. 8 illustrates another schematic driving scheme for the display panel.

FIG. 8 illustrates another schematic driving scheme of the display panel 106. In the example of FIG. 8, frames 802 and 806 are successive frames from the input data Din, and frame 804 is an interleaved frame produced based on frames 802 and 806.

In this example, frames 802 and 806 include dynamic image content in their upper-right portion and static image content in their upper-left portion and lower portion. Thus, for the gate lines (e.g., GL(1)-GL(i)) disposed in the upper portion of the display panel 106, they may pass through both the static display area STA and the dynamic display area DDA, while for the gate lines (e.g., GL(i+1)-GL(M)) disposed in the lower portion of the display panel 106, they pass through the static display area STA only.

In frame time FT802, the display panel 106 is driven by normal scheme. The controller 108 controls the driver circuit 12 to update the previous displayed content on the display panel 106 to frame 802.

In frame time FT804, to avoid losing any information of the dynamic image content, the update of displayed content for any display area that includes gate lines (e.g., GL(1)-GL(i)) passing through the dynamic display area DDA will not be disabled. As shown in FIG. 8, because the upper portion of the display panel 106 includes gate lines (e.g., GL(1)-GL(i)) passing through both the static display area STA and the dynamic display area DDA, the displayed content for the upper portion of the display panel 106 will be updated by the driver circuit 12 normally. On the other hand, because the gate lines (e.g., GL(i+1)-GL(M)) in the lower portion of the display panel 106 pass through the static display area STA only, the displayed content for the lower portion (which is represented as a shadowed region in the figure) of the display panel 106 will not be updated by the driver circuit 12.

In frame time FT806, the display panel 106 is driven by normal scheme again. The driver circuit 12 responds to the controller 108 to update the whole displayed content to frame 806.

Figure 9:
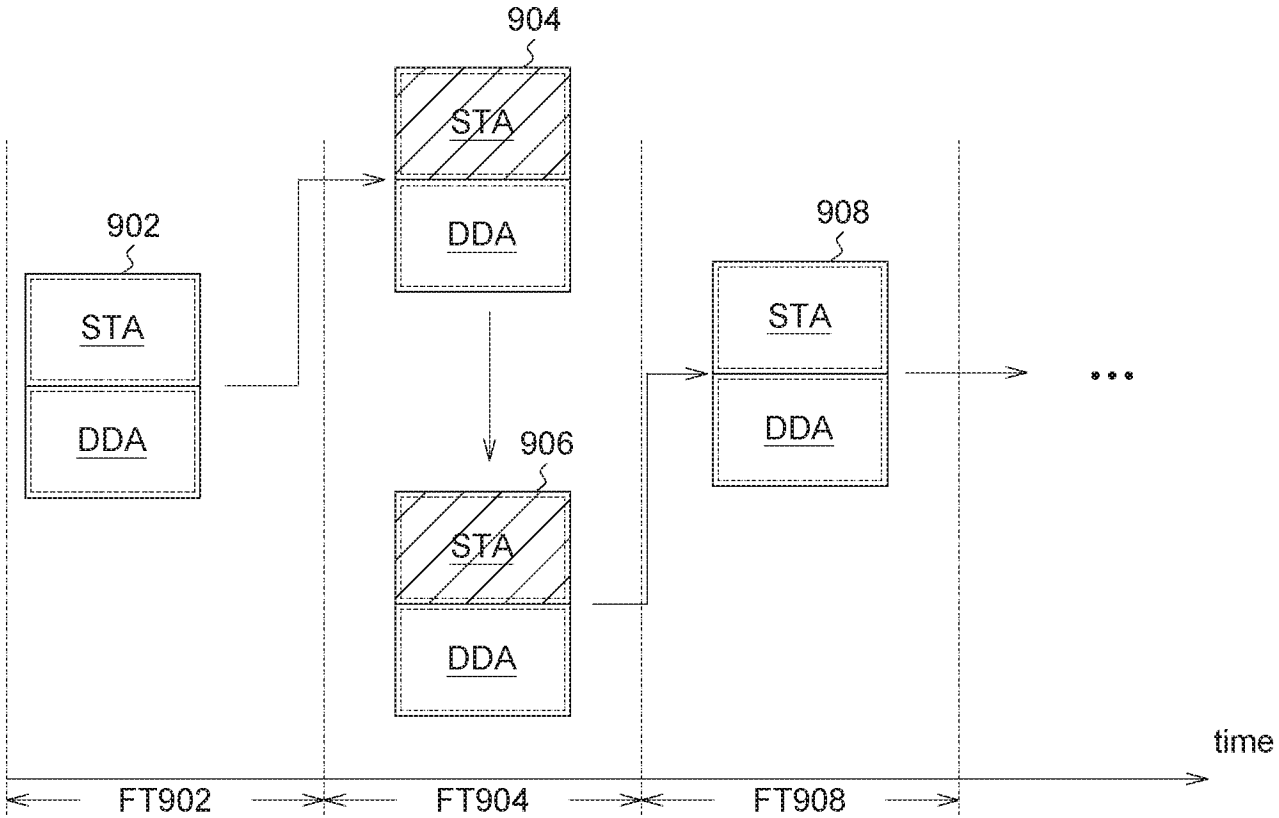
FIG. 9 illustrates another schematic driving scheme for the display panel.

FIG. 9 illustrates another schematic driving scheme of the display panel 106. In the example of FIG. 9, frames 902 and 908 are successive frames in the input data Din, and frames 904 and 906 are interleaved frames produced based on frames 902 and 908.

In this example, it is assumed that both frames 902 and 908 include static image content in their upper portion and include dynamic image content in their lower portion, so the interleaved frames 904 and 906, which are produced based on the frames 902 and 908, are identified as including static image content in their upper portion and having dynamic image content in their lower portion.

In frame time FT902, the display panel 106 is driven by normal scheme. The driver circuit 12 enables the gate lines and data lines to update the displayed content on the display panel 106 to frame 902.

In frame time FT904, frames 904 and 906 are successively displayed on the display panel 106. During the period of time that frame 904 is displayed, the controller 108 skips updating data of pixels within the static display area STA, and directly jumps to updating data of pixels within the dynamic display area DDA. After data of pixels within the dynamic display area DDA are updated to the dynamic image content of frame 904, the controller 108 then uses the rest of frame time FT904 to display the next frame 906. That is, the controller 108 may use the rest of frame time FT904 to update the displayed content in the dynamic display area DDA to the dynamic image content of frame 906. In this manner, the frame rate for the frame's dynamic image content can be raised without increasing the operating frequency of the driver circuits. In frame time FT908, the display panel 106 is driven by normal scheme, to update the displayed content on the display panel 106 to frame 908.

Figure 10:
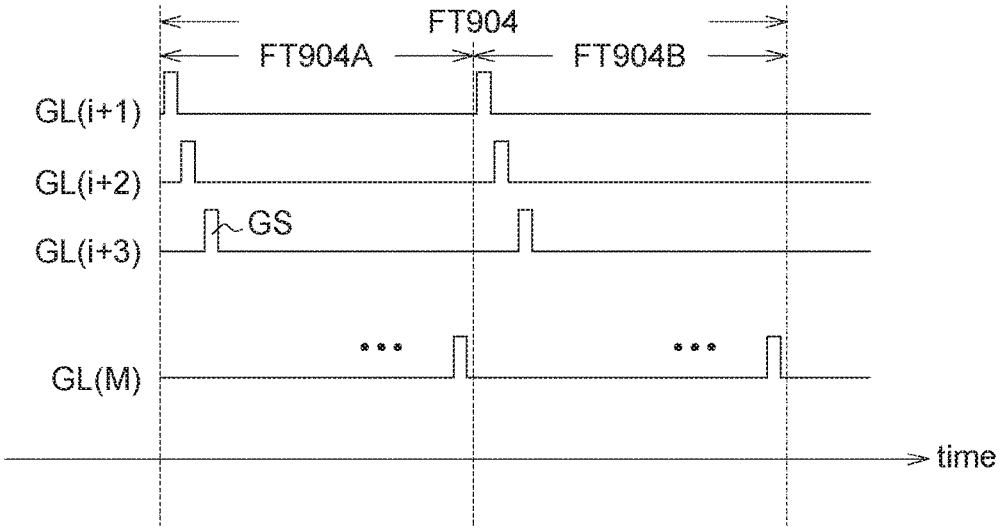
FIG. 10 illustrates a schematic timing chart of operations of the display panel.

FIG. 10 illustrates a schematic timing chart of operations of the display panel 106 during the frame time FT904 shown in FIG. 9.

In the example of FIG. 10, frame time FT904 is divided into sub-frame times FT904A and FT904B, wherein sub-frame time FT904A is the period of time that frame 904 is displayed, and sub-frame time FT904B is the period of time that frame 906 is displayed.

Because the update for the displayed content of the static display area STA is skipped according to the driving scheme, the sub-frame time FT904A will begin with the update for the displayed content of the dynamic display area DDA. As shown in FIG. 10, from the beginning of sub-frame time FT904A, the scan signals GS are sequentially applied to the gate lines GL(i+1)-GL(M) passing through the dynamic display area DDA of the display panel 106, such that data of pixels within the dynamic display area DDA are updated to the dynamic image content of frame 904.

In sub-frame time FT904B, i.e., the rest of frame time FT904, scan signals GS are sequentially applied to the gate lines GL(i+1)-GL(M) within the dynamic display area DDA for the next frame 906, such that data of pixels within the dynamic display area DDA can be updated to the dynamic image content of frame 906.

Although the number of interleaved frames containing static image content displayed in one frame time is shown by two in FIG. 9, the invention is not limited thereto. The number of interleaved frames displayed in one frame may be arbitrary, depending on different applications. Further, in the present invention, the size, shape, quantity and location of the static display area STA and the dynamic display area DDA can be arbitrary, depending on actual frame content.

Based on the above, the proposed display method can reduce the power consumption of the driver circuit without adversely affecting the display quality. When an interleaved frame is displayed, the controller may control the driver circuit to disable/skip the update for the displayed content of the static display area to save power and reduce operating temperature.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A display method of a display device including a controller, a display panel and a driver circuit responsive to the controller to drive the display panel, comprising:

receiving, by the controller, a first frame and a second frame from an input data;

up-converting, by the controller, a frame rate of the input data to produce a third frame based on the first frame and the second frame;

identifying, by the controller, a static image content of the third frame according to a comparison of the first frame and the second frame; and controlling, by the controller, the driver circuit not to update data of pixels within a static display area of the display panel corresponding to the static image content during the period of time that the third frame is displayed by the display panel;

comparing the first frame with the second frame to recognize image content that remains unchanged between the first frame and the second frame as the static image content, and to recognize image content that varies between the first frame and the second frame as a dynamic image content of the third frame;

jumping to updating data of pixels within a dynamic display area of the display panel corresponding to the dynamic image content of the third frame by skipping updating the data of the pixels within the static display area of the display panel in a frame time; and after the data of the pixels within the dynamic display area are updated to the dynamic image content of the third frame, using the rest of the frame time to display a fourth frame, wherein the fourth frame is produced based on the first frame and the second frame.

2. The display method according to claim 1, wherein the driver circuit comprises a gate driver and a source driver, and the display method further comprises:

holding the data of the pixels within the static display area when the third frame is displayed by deactivating at least one of the gate driver and the source driver.

3. The display method according to claim 1, further comprising:

interpolating the first frame and the second frame to produce the third frame.

4. The display method according to claim 1, wherein the first frame and the second frame are two successive frames in the input data.

* * * * *